US010967599B2

(12) United States Patent
Rapparini

(10) Patent No.: US 10,967,599 B2
(45) Date of Patent: Apr. 6, 2021

(54) METHOD AND MACHINE FOR FORMING PACKAGES OF FLEXIBLE MATERIAL HAVING SIDE GUSSETS

(71) Applicant: ICA S.p.A, Bologna (IT)

(72) Inventor: Gino Rapparini, Bologna (IT)

(73) Assignee: ICA S.P.A., Bologna (IT)

( * ) Notice: Subject to any disclaimer, the term of this patent is extended or adjusted under 35 U.S.C. 154(b) by 194 days.

(21) Appl. No.: 15/953,663

(22) Filed: Apr. 16, 2018

(65) Prior Publication Data

US 2018/0311922 A1 Nov. 1, 2018

(30) Foreign Application Priority Data

Apr. 27, 2017 (IT) ..... 102017000045963

(51) Int. Cl.

| | |
|---|---|
| ***B31B 70/26*** | (2017.01) |
| ***B31B 70/02*** | (2017.01) |
| ***B31B 70/16*** | (2017.01) |
| ***B31B 70/64*** | (2017.01) |
| ***B31B 70/36*** | (2017.01) |
| *B31B 155/00* | (2017.01) |
| *B65D 30/20* | (2006.01) |

(52) U.S. Cl.

CPC ..... *B31B 70/266* (2017.08); *B31B 70/024* (2017.08); *B31B 70/16* (2017.08); *B31B 70/36* (2017.08); *B31B 70/644* (2017.08); *B31B 70/645* (2017.08); *B31B 2155/0012* (2017.08); *B65D 31/10* (2013.01)

(58) Field of Classification Search

None

See application file for complete search history.

(56) References Cited

U.S. PATENT DOCUMENTS 2,055,086 A 6/1934 Poppe
2,737,860 A * 3/1956 Randall ..... B31B 70/00 493/235

(Continued)

FOREIGN PATENT DOCUMENTS

| | | |
|---|---|---|
| DE | 102008039953 | 12/1998 |
| JP | 2013-249135 | 12/2013 |
| JP | 2015 217985 | 12/2015 |

OTHER PUBLICATIONS

Italian Search Report and opinion dated Jan. 10, 2018 in the corresponding Italian application No. 10 2017000045963; 8 pages.

*Primary Examiner* — Hemant Desai
*Assistant Examiner* — Tanzim Imam
(74) *Attorney, Agent, or Firm* — Fattibene and Fattibene LLC; Paul A. Fattibene

(57) ABSTRACT

The present invention relates to a method for forming packages of flexible material with a first side gusset and a second side gusset starting from a strip coming from a reel having a sliding direction. The method comprises the following steps: making the first gusset by folding close to a first side edge of the strip coming from the reel, and making the second gusset by folding the strip coming from the reel; in which the step of making the second gusset is performed on a portion of the strip which extends in the sliding direction after the step of making the first gusset was performed on the portion of the strip. Moreover, the present invention relates to a machine configured so as to carry out the method.

10 Claims, 10 Drawing Sheets

(56) References Cited

U.S. PATENT DOCUMENTS

| | | | | |
|---|---|---|---|---|
| 8,167,487 | B2 * | 5/2012 | Fuller | B31B 70/00 383/5 |
| 8,597,168 | B2 * | 12/2013 | Koesters | B65D 31/10 493/226 |
| 2008/0205801 | A1 * | 8/2008 | Alaux | B65D 31/10 383/120 |
| 2010/0192524 | A1 | 8/2010 | Rapparini | 53/512 |
| 2014/0187401 | A1 * | 7/2014 | Totani | B65D 31/10 493/196 |
| 2017/0173913 | A1 | 6/2017 | Totani | B31B 37/00 |

* cited by examiner

METHOD AND MACHINE FOR FORMING PACKAGES OF FLEXIBLE MATERIAL HAVING SIDE GUSSETS

FIELD OF THE INVENTION

The present invention relates to the technological field of the formation of packages of flexible material having side gussets. In particular, the present invention relates to a method and to a machine capable of making such packages.

BACKGROUND OF THE INVENTION

Today, packages having side gussets are widely used because the presence of the gussets allows significantly increasing the quantity of material contained inside the package, and therefore allows for example, making packages that allow having a much larger filling volume, front surface being equal.

These types of packages are for example, significantly required in the field of pet food. Such types of packages normally are made in a continuous manner starting from a strip of flexible material coming from a reel. Such packages may be sold as individual packages ready to be filled and also as a reel having the packages positioned one after the other on a single strip.

However, the machines used in making such packages are very cumbersome because normally the production of the two side gussets occurs simultaneously in the same station. For this reason, packages having reduced sizes are made in most cases so as to have a less cumbersome machine and reduced costs.

It is a main object of the present invention to make packages having also increased sizes while however maintaining reduced overall dimensions of the manufacturing machine.

SUMMARY OF THE INVENTION

The present invention is based on the idea of making the two side gussets one after the other so as to divide making the two gussets in two stations, each configured so as to make a single gusset.

When it is described that one step is performed "following" another step in the present invention, it means reference is made to a given step in a given position along the sliding direction of the strip, unless otherwise specified.

Indeed, since the manufacturing method preferably is a continuous manufacturing method, inevitably most of the processes described are performed simultaneously because for example, while one station is performing a particular process, the other station simultaneously is performing another process. However, the two processes here relate to different positions along the sliding direction of the strip.

For example, taking a portion of the strip positioned in a position x along the sliding direction of the strip and another position $x+\Delta x$ placed again on the sliding direction of the strip, the expression that one step is performed "following" another one means describing that one step is performed following the other precisely on that specific strip portion. $\Delta x$ may for example, be equal to the height of the package. In this case, a step that is performed following another one means that to make that specific package, the second step is performed only after the first step was completed.

Moreover, the terms "upstream", "downstream", "at the top" and "at the bottom" in the present invention refer to the sliding direction of the strip coming from the reel downstream of which the whole forming process of the package of flexible material develops. In other words, the terms "downstream" and "upstream" refer to the advancement direction of the strip during the production process.

Moreover, when a strip portion that extends in the sliding direction is mentioned in the present invention, reference is made to any strip portion having a width equal to the width of the strip and that extends along the sliding direction of the strip. Similarly, when a portion of tubular element that extends in the sliding direction is mentioned, reference is made to any portion of tubular element having a width equal to the width of the tubular element and that extends along the sliding direction of the tubular element. Such portions may have any length, unless otherwise specified.

According to one embodiment of the present invention, a method is provided for forming packages of flexible material with a first side gusset and a second side gusset starting from a strip coming from a reel having a sliding direction, the method comprising the following steps:

a) making the first gusset by means of folding along a first side edge of the strip coming from the reel, b) making the second gusset by means of folding the strip coming from the reel;

in which step b) is performed on a strip portion that extends in the sliding direction after step a) was performed on such portion.

Therefore, this solution implies that to make a package, making the second gusset may advantageously be started only after the first gusset was formed by means of folding. This solution is particularly advantageous because it allows separating making the first gusset from making the second gusset. This allows executing the step of making the gussets in two particularly compact stations because each of them is to be configured so as to form only one of the two gussets. Moreover, the stations may be placed in series with each other, for example aligned or also slightly offset, thereby effectively reducing the overall side dimensions of the machine. Such method is particularly advantageous because the separate making of the two gussets allows having a simpler gusset making process, and therefore a machine may be had that is capable of performing such process in a simpler manner and with reduced costs and sizes. For example, the overall dimensions of the machine being equal, it is possible with this method to produce packages having a greater volume, which is particularly advantageous in terms of the field of pet food, where at times packages capable of containing an increased quantity of material are required. Making the second gusset preferably occurs close to a central zone of the initial strip, in which the "central zone of the strip" means the central zone of the strip after the first gusset was made, and therefore the strip referred to preferably has a smaller width with respect to the strip on the reel because part of the strip was used to make the first gusset. First and second gusset means a part of accordion-folded sheet that is formed by folding the sheet along at least two preferably parallel folding lines.

According to one embodiment of the present invention, a method is provided for forming packages of flexible material with a first side gusset and a second side gusset starting from a strip coming from a reel in which such strip portion on which step b) is performed after step a) is performed has a length preferably equal to at least ¼ of the height of the package, more preferably to at least ⅔ of the height of the package, even more preferably to at least ¾ of the height of the package, even more preferably again to at least the height of the package, even more preferably again it has a height equal to at least twice the height of the package, even more preferably to at least three times or four times the height of the package. This solution is particularly advantageous because it allows clearly separating the first station from the second one, thus significantly reducing the overall side dimensions of the machine.

According to a further embodiment of the present invention, a method is provided for forming packages of flexible material with a first side gusset and a second side gusset starting from a strip coming from a reel in which the method further comprises the following step:

c) folding the strip coming from the reel so that the first side edge of the strip coming from the reel is at the second side edge of the strip coming from the reel so as to form an open tubular element;

in which step c) is performed on a strip portion that extends in the sliding direction preferably after step b) was performed on such portion.

According to a further embodiment of the present invention, a method is provided for forming packages of flexible material with a first side gusset and a second side gusset starting from a strip coming from a reel in which the method further comprises the following step:

d) sealing the side edges of the strip so as to make a closed tubular element;

in which step d) is performed on a strip portion that extends in the sliding direction after step c) was performed on such portion.

According to a further embodiment of the present invention, a method is provided for forming packages of flexible material with a first side gusset and a second side gusset starting from a strip coming from a reel in which the method further comprises the following step:

e) sealing the outer side edges of the first and second gusset so as to reinforce the outer side edges;

in which step e) is performed on a strip portion that extends in the sliding direction preferably at the same time in which step d) was performed on such portion.

This solution is particularly advantageous because it allows both closing the tubular element and reinforcing the side edges by means of sealing in one sealing step alone. The fact of having all the outer edges of the first and the second gusset which have a sealed surface close to the edge is particularly advantageous because it allows effectively preventing a tearing of the gusset which may be due for example, to the weight of the material contained therein, or may be due for example, to a force applied to open the package. Since these are usually quite tall packages, the sealed edges give structural rigidity to the package and help its squaring once filled. The width of such sealed surfaces may preferably vary between 3 and 15 mm.

According to a further embodiment of the present invention, a method is provided for forming packages of flexible material with a first side gusset and a second side gusset starting from a strip coming from a reel in which the method further comprises the following step:

f) sealing a transverse surface of the tubular element made from a strip coming from a reel in which the seal has a length equal to the distance between the outer edge of the first gusset and the outer edge of the second gusset so as to make a bottom closure of the package;

in which step f) is performed on a strip portion that extends in the sliding direction preferably after step c) was performed on such portion.

This solution is particularly advantageous because it is possible to close the package at the bottom by means of such sealing. Indeed it is clear that the height of the sealing equal to the distance between the gussets means that such sealing effectively allows closing the package at the bottom. Moreover, such sealing preferably is of the "K" type. Such solution is particularly advantageous because the K structure is particularly advantageous here because it allows closing the bottom inner edges of the package, thus simultaneously preventing the product from entering the gap that would be created if such sealing were not performed. Moreover, such type of sealing allows forming the square bottom of the package, giving it also an increased structural resistance and rigidity.

According to a further embodiment of the present invention, a method is provided for forming packages of flexible material with a first side gusset and a second side gusset starting from a strip coming from a reel in which the method further comprises the following step:

g) cutting the tubular element made from the strip coming from the reel along an axis perpendicular to the sliding direction of the tubular element so as to separate the packages of flexible material from one another.

According to a further embodiment of the present invention, a method is provided for forming packages of flexible material with a first side gusset and a second side gusset starting from a strip coming from a reel in which the cutting step g) is followed by the following step:

h) folding a surface placed at the bottom of the tubular element made from the strip coming from the reel along a direction perpendicular to the sliding direction of the tubular element and securing the surface by means of the application of glue so as to make the bottom of the package.

This solution is particularly advantageous because it allows having a package with reinforced flat bottom so as to ensure increased resistance and stability.

According to a further embodiment of the present invention, a method is provided for forming packages of flexible material with a first side gusset and a second side gusset starting from a strip coming from a reel in which the reel is unwound in a continuous manner so as to form a plurality of packages. This solution is particularly advantageous because due to the continuous sliding of the reel, it allows forming a continuous plurality of packages and preferably performing steps a) and b) on the same conveying line and therefore continuously. Here for example, while step a) preferably relates to the formation of the first gusset of a first package, step b) relates to the formation of the second gusset of a second package, different from the first one and which is formed downstream with respect to the first one. Steps a) and b) therefore occur in a continuous manner and simultaneously to the formation of different packages, but they preferably occur one following the other with reference to the formation of a specific package.

Moreover, based on further embodiments of the present invention, also one or more of steps c), d), e), f), g) and h) may preferably be performed in series on the same conveying line on which steps a) and b) are performed.

According to a further embodiment of the present invention, a machine is provided configured to execute the method according to one of the embodiments described above.

According to a further embodiment of the present invention, a machine is provided for forming packages of flexible material with a first side gusset and a second side gusset, the machine comprising: a first station configured so as to accommodate a strip coming from a reel and to make the first gusset at a first side edge of the strip, and a second station configured so as to make the second gusset, in which the second station is placed downstream of the first station. This solution is particularly advantageous because it allows separating making the first gusset from making the second gusset. This allows performing the step of making the gussets in two particularly compact stations because each of them is to be configured so as to make only one of the two gussets. Therefore, such machine is particularly advantageous because the separate making of the two gussets allows having a simpler process of making gussets and therefore having a machine capable of performing such process in a simpler manner and with reduced costs and sizes. Indeed according to this particular embodiment, the stations may be placed in series with each other, for example aligned or also slightly offset, thus effectively reducing the overall side dimensions of the machine. First and second gusset means a part of accordion-folded sheet that is formed by folding the sheet along at least two preferably parallel folding lines.

According to a further embodiment of the present invention, a machine is provided for forming packages of flexible material with a first side gusset and a second side gusset, in which preferably the strip outlet from the first station travels a stretch equal to at least ¼ of the height of the final package before reaching the second station; more preferably, the strip outlet from the first station travels a stretch equal to at least ⅔ of the height of the final package before reaching the second station; even more preferably, the strip outlet from the first station travels a stretch equal to at least ¾ of the height of the final package before reaching the second station; even more preferably, the strip outlet from the first station travels a stretch equal to at least the height of the final package before reaching the second station; even more preferably, the strip outlet from the first station travels a stretch equal to at least 2 to 4 times the height of the final package before reaching the second station, so as to separate the two stations even more clearly. Such solutions are particularly advantageous because they allow clearly separating the first station from the second station and therefore having a simpler process of making gussets and therefore having a machine capable of performing such process in a simpler manner and with reduced costs and sizes, in particular with reduced overall side dimensions.

According to a further embodiment of the present invention, a machine is provided for forming packages of flexible material with a first side gusset and a second side gusset, in which the second station is configured so as to fold the strip so that the first side edge of the strip is at the second side edge of the strip so as to form an open tubular element. This solution is particularly advantageous because it allows folding the strip so as to obtain an open tubular element ready to be closed, when the second gusset is being made.

According to a further embodiment of the present invention, a machine is provided for forming packages of flexible material with a first side gusset and a second side gusset, in which the machine further comprises a sealer configured to seal the outer side edges of the strip with each other so as to make a closed tubular element.

According to a further embodiment of the present invention, a machine is provided for forming packages of flexible material with a first side gusset and a second side gusset, in which the machine further comprises two sealers, each preferably having a pair of side sealing bars configured so as to seal the outer side edges of the first and of the second gusset so as to make a closed tubular element and so as to reinforce the outer side edges. This solution is particularly advantageous because it allows both closing the tubular element and reinforcing the side edges by means of sealing in one sealing step alone. The fact of having all the outer edges of the first and the second gusset having a sealed surface is especially advantageous because it allows effectively preventing a tearing of the gusset which may be due for example, to the material contained therein, or may be due for example, to a force applied to open the package. The sealed edges give structural rigidity to the package and help its squaring once filled.

According to a further embodiment of the present invention, a machine is provided for forming packages of flexible material with a first side gusset and a second side gusset, further comprising a sealer preferably having a pair of sealing bars, the sealer being configured to make a bottom closure of the package. Such sealing preferably is of the "K" type. Such solution is particularly advantageous because the K structure is particularly advantageous here because it allows closing the bottom inner edges of the package, thus simultaneously preventing the product from entering the gap that would be created if such sealing were not performed. Moreover, such type of sealing allows forming the square bottom of the package, giving it also an increased structural resistance and rigidity.

According to a further embodiment of the present invention, a machine is provided for forming packages of flexible material with a first side gusset and a second side gusset, further comprising a cutter configured so as to cut the tubular element so as to separate the packages of flexible material from one another.

According to a further embodiment of the present invention, a machine is provided for forming packages of flexible material with a first side gusset and a second side gusset, in which the machine is configured so as to provide the strip in a continuous manner from the reel to the second station through the first station. This solution is particularly advantageous because it allows having a single conveying line capable of making a plurality of packages in a continuous manner.

According to a further embodiment of the present invention, a machine is provided for forming packages of flexible material with a first side gusset and a second side gusset, in which the at least one among the lateral sealing station, the transverse sealing station, the cutting station and the folding station is placed in series to the first station and to the second station.

BRIEF DESCRIPTION OF THE DRAWINGS

The present invention is described with reference to the accompanying drawings in which the same numbers and/or reference marks indicate the same parts and/or similar and/or corresponding parts of the system. In the drawings.

DETAILED DESCRIPTION OF THE INVENTION

Figure 1:
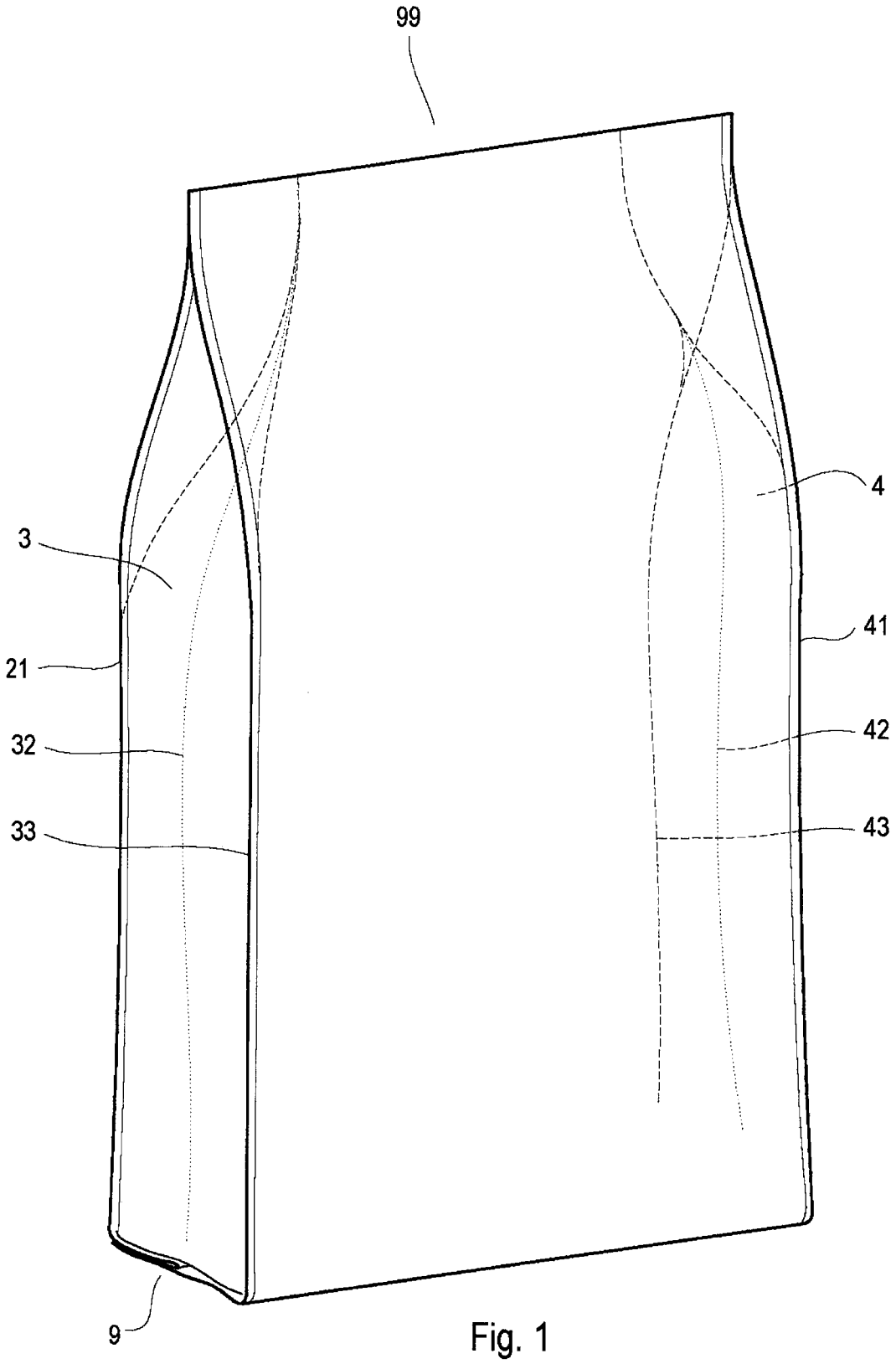
FIG. 1 diagrammatically illustrates a package that can be made according to one embodiment of the present invention.

The present invention is described below making reference to particular embodiments, as shown in the accompanying drawings. However, the present invention is not limited to the particular embodiments described in the following detailed description and depicted in the drawings, but rather the embodiments described simply exemplify the various aspects of the present invention, the aim of which is defined by the claims. Further modifications and variants of the present invention will be clear to those skilled in the art.

As shown in FIG. 1, the present invention relates to forming a package 99 of flexible material having a first side gusset 3 and a second side gusset 4. Preferably, the sizes of the first side gusset 3 and those of the second side gusset 4 are similar so as to have a symmetrical package; even more preferably they are the same. Moreover, the package preferably has a folded bottom 9 which increases the resistance of the base of the package and efficiently prevents an accidental exit of material from the inside of the package.

Such package may also have very large sizes so as to allow the storage of a large quantity of material. For example, a package made according to one embodiment of the present invention may have a width equal to 300-400 mm, a height equal to 700-800 mm and a depth of 100-200 mm. However, the packages may also have larger volumes, for example they may have a volume of 20-30 litres.

With reference to figures from 2 to 12, a method is described for making a package 99 like the one depicted in FIG. 1.

A plurality of packages like the one shown in FIG. 1 may be made in a continuous manner from a tubular element 5 made starting from a strip 2 coming from a reel 1 which is unwound therefrom by means of the rotation of the reel 1 about its axis Ax1.

Below is the presentation of the various steps starting from any strip portion 98 which, starting from reel 1, may enter the various stations in order to be processed.

Figure 2:
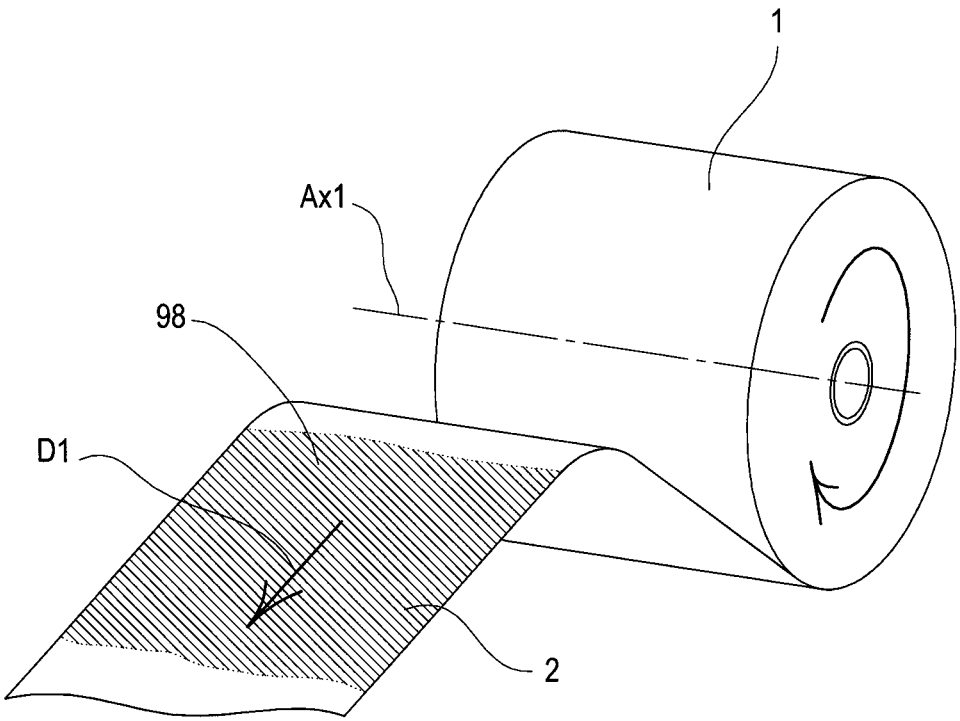
FIG. 2 diagrammatically illustrates the reel from which the strip is unwound to form the package according to one particular embodiment of the present invention.

In the particular embodiment of FIG. 2, by rotating the reel 1 clockwise, it is possible to continuously provide the strip 2 to a first station 100 of a machine configured so as to make the packages. The machine comprises at least the first station 100 and the second station 101. For example, it is possible to make a first package 99 of flexible material from the strip portion 98. However, such strip portion 98 is depicted here only to describe and show the reader the movement of the strip 2 between one station and the other. In the drawings, for descriptive purpose, the strip portion 98 has a smaller length than the one of a package 99. Such configuration is simply due to the particular need to depict several parts of the machine within the same drawing. Therefore, those skilled in the art will understand that such portion may have different sizes as indicated in the claims, such as for example a length equal to the one of a package or preferably even greater.

Figure 3:
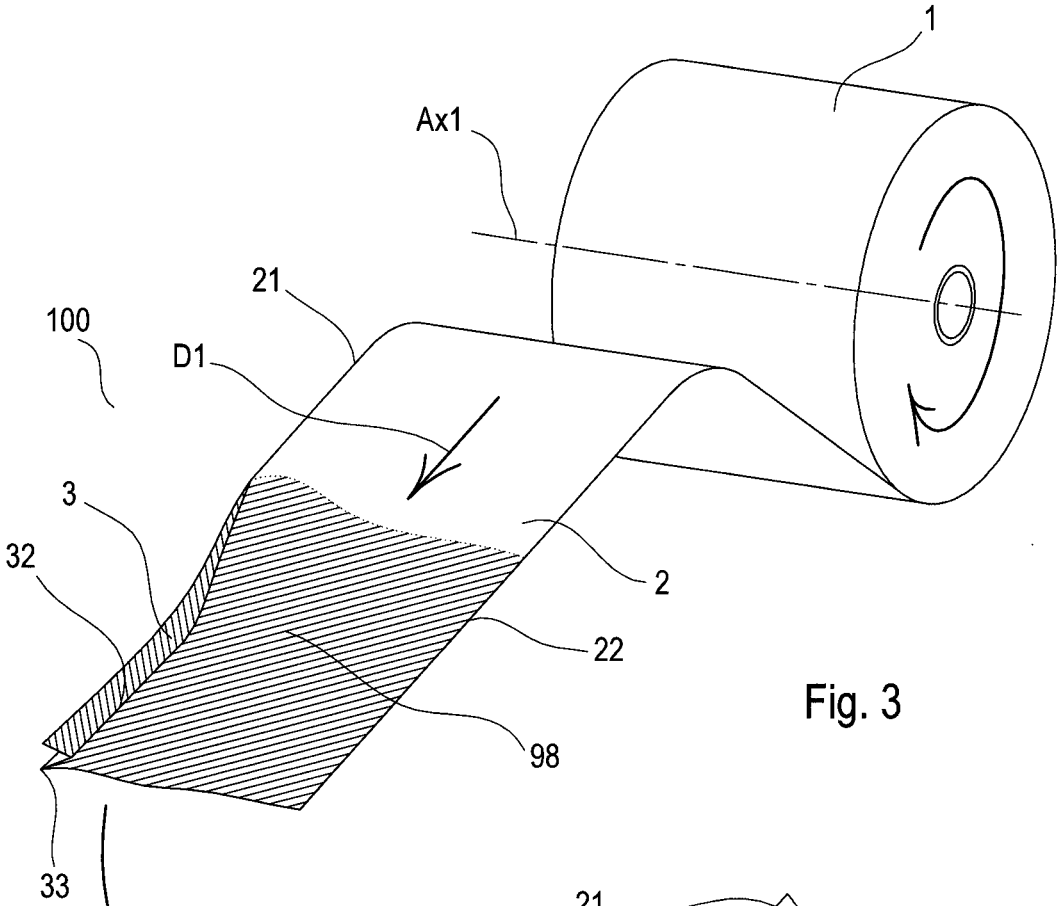
FIG. 3 diagrammatically illustrates the formation of the first gusset according to one particular embodiment of the present invention.
Figure 3A:
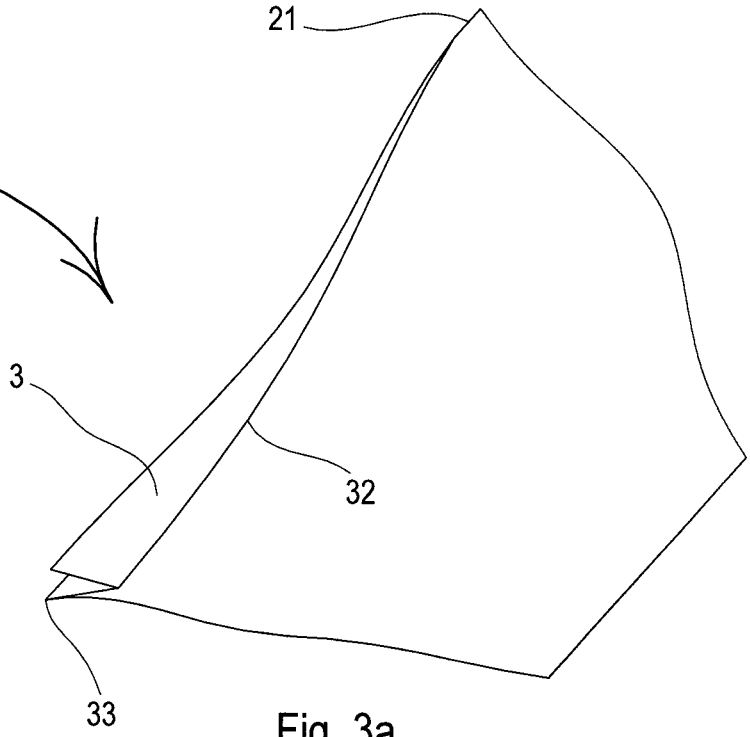
FIG. 3*a* shows an enlargement of a detail of FIG. 3.

The strip 2, which has a first side edge 21 and a second side edge 22, is therefore conveyed along a sliding direction D1 towards the first station 100 configured so as to form the first gusset 3 by folding the strip 2 at the zone of the side edge 21 of the strip 2. As is shown in the detail of FIG. 3*a*, the gusset 3 preferably is made by means of folding the strip along two parallel lines 32, 33 placed close to the side edge 21 of the strip 2 having a direction parallel to the sliding direction D1 of the strip 2, and therefore forming a lateral accordion structure.

Therefore, as is clear from the above description, the formation of a gusset may simply occur by folding a sheet along two parallel folding lines so as to form a concave portion. In this particular example, the concave portion is the one formed between the edge 21 and the folding line 33.

Thus, there will be a strip 2 at the outlet of the first station 100 like the one inlet into the first station 100 with the only difference being that one of the two side edges of the strip 2—which in the particular case depicted in the drawing is depicted by the side edge 21—was accordion-folded so as to form the first gusset 3. Therefore, the width of the strip 2 outlet from the first station 100 is less than the one that the strip 2 had at the inlet of the first station 100 because a side part of the strip 2 was used to make the first gusset 3.

The strip 2 may also preferably have a flat shape like the one it had when inlet to the first station 100, therefore having the first side edge 21 of the strip 2 in contact with the folding line 33 and the folding line 32 in contact with the strip 2. Moreover, more generally, at the outlet of the first station 100, the first gusset 3 may preferably have a flat shape, that is with a flattened, and therefore compact, accordion structure. However, it is also possible for the strip 2 outlet from the first station 100 to have a slightly open shape of the first gusset 3 in which the first side edge 21 of the strip is spaced apart from the folding line 33.

Figure 4:
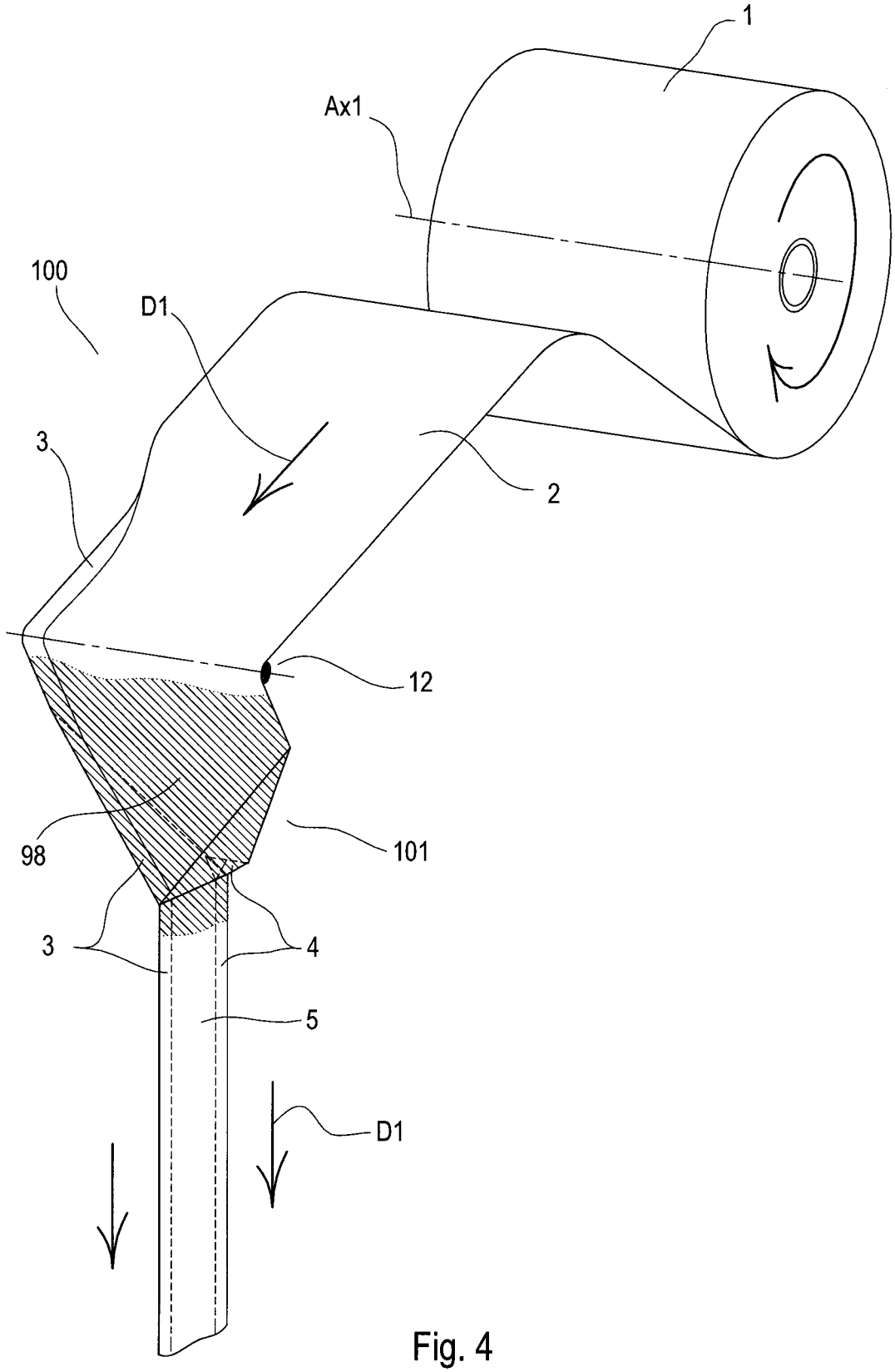
FIG. 4 diagrammatically illustrates the formation of the second gusset and the folding of the strip according to one particular embodiment of the present invention.

As shown in FIG. 4, after the strip 2 comes out of the first station 100 with the first gusset 3 made on one of its side edges (in particular, the one to the left in the drawing), the strip 2 is conveyed into a second station 101 configured so as to fold the strip 2, thus forming the second gusset 4. For example, this operation may be performed by means of a shaper.

The distance between the first station 100 and the second station 101 may be made as liked. Preferably, the strip 2 outlet from the first station 100 travels a stretch equal to at least ¼ of the height of the final package 99 before reaching the second station 101. More preferably, the strip 2 outlet from the first station 100 travels a stretch equal to at least ⅔ of the height of the final package 99 before reaching the second station 101. Even more preferably, the strip 2 outlet from the first station 100 travels a stretch equal to at least ¾ of the height of the final package 99 before reaching the second station 101. Even more preferably, the strip 2 outlet from the first station 100 travels a stretch equal to at least the height of the final package 99 before reaching the second station 101. In the latter case, the beginning of the formation of the second gusset 4 of a first package preferably occurs only after the formation of the first gusset 3 of that specific package was completed. Even more preferably, the strip 2 outlet from the first station 100 travels a stretch equal to at least 2 to 4 times the height of the final package 99 before reaching the second station 101, so as to separate the two stations even more clearly.

When for example, the strip is to travel a distance equal to at least 4 times the height of the final package before reaching the second station 101, the result is that while the second gusset 4 of a package 99 is in the forming step in the second station 101, the first station 100 is making the first gusset of another package placed upstream with respect to such package 99 by at least other 4 packages. However, it is clear that the distance that the strip travels between the first station 100 and the second station 101 may be made as liked. Therefore, in the case there are particular construction needs, it is also possible for such distance to be greater than 4 times the height of the final package 99.

As shown in the detail of FIG. 5, also the second gusset 4 preferably is made by means of folding the strip along parallel lines 42, 43 preferably placed in the central zone of the strip 2 having a direction parallel to the sliding direction D1 of the strip 2, and therefore forming a lateral accordion structure. Such central zone clearly refers to the central zone of the strip 2 outlet from the first station 100 and therefore, as described above, having a smaller width with respect to the strip 2 on the reel 1 from which it is unwound. It is clear here, as for the first gusset, the formation of a gusset may simply occur by folding a sheet along two preferably parallel folding lines so as to form a concave portion. In this particular example, the concave portion is the one formed between the folding line 43 and the position in which, as described below, the folding line 41 will be positioned.

Moreover, the folding of the strip 2 may be performed along the folding line 41 to form an open tubular element 5, preferably simultaneously to making the second gusset 4. Therefore, the second station 101 may preferably also be configured so as to fold the strip 2 so that the first side edge 21 of the strip 2 coming from the reel 1 is at the second side edge 22 of the strip 2.

FIGS. 5*a*-5*e* show a section view of the strip 2, showing the details of the various steps required for making the two side gussets.

Figure 5A:
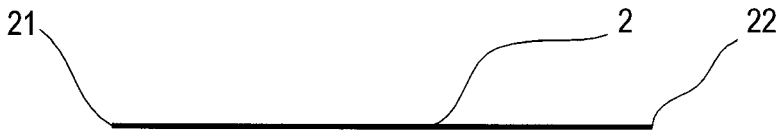
FIGS. 5*a*-5*e* show a section view of the various steps of making the first and the second gusset and of folding the strip, according to one particular embodiment of the present invention.

FIG. 5*a* shows the transverse section of a strip 2, like the one in FIG. 2, that is before entering the first station 100.

Figure 5B:
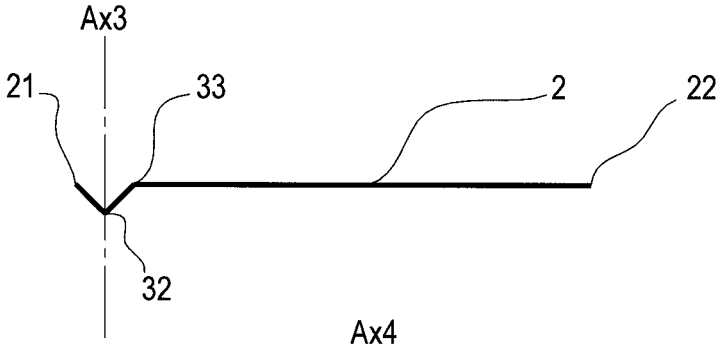

Then, as shown in the section view of FIG. 5*b*, and as presented previously, the first gusset 3 is made by folding in the zone of the first side edge 21 of the strip 2. As specified above, the folding is performed along the two folding lines 32, 33. More specifically, the formation of the first gusset 2 is performed along the axis Ax3 depicted.

Figure 5C:
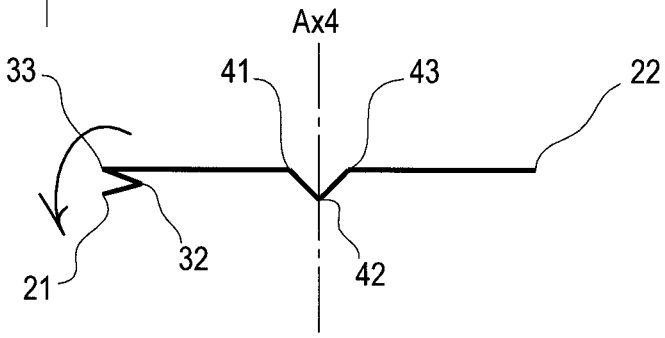

Then, as shown in FIG. 5*c*, preferably the formation of the second gusset 4 occurs by means of folding the strip 2 along the parallel lines 41, 42, 43, placed in a central zone of the strip 2, that is along the imaginary axis Ax4 shown in the drawing. As shown in the drawing, the axis Ax4 preferably is placed in a central position between the second side edge 22 of the strip 2 and the folding line 33 of the first gusset 3.

Figure 5D:
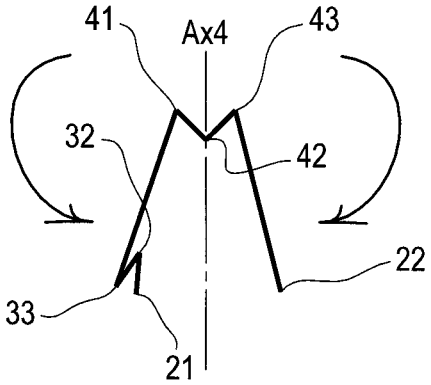

The folding process shown in FIG. 5*d* may preferably occur simultaneously with the forming process of the second gusset 4 shown in FIG. 5*c*. However, it is also possible to perform the folding process after the second gusset 4 was formed, in line with that shown in the FIGS. 5*c* and 5*d*, respectively. If the processes occur simultaneously, clearly this involves going directly from the configuration shown in FIG. 5*b* to the configuration shown in FIG. 5*d*.

Figure 5E:
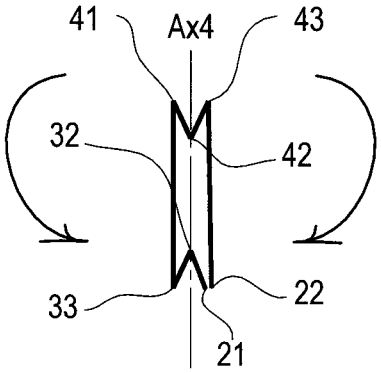

The folding line 41 may preferably be used as pivot about which to fold the strip 2 so as to form the open tubular element 5 in which the first edge 21 of the strip 2 and the second edge 22 of the strip 2 are placed at each other, as shown in FIGS. 5*d* and 5*e*, respectively. As shown in the drawing, the folding line 41 may preferably be close to the centre between the side edges 21 and 22 of the strip 2.

At this point, the strip 2, at the outlet of the second station 101, will therefore have taken on the shape of an open tubular element 5 configured so as to have a smaller width with respect to half of the initial width of the strip 2 because part of the strip 2 was accordion-folded to form the two side gussets. Such open tubular element 5 preferably has a flat shape so as to occupy as little space as possible.

Figure 6:
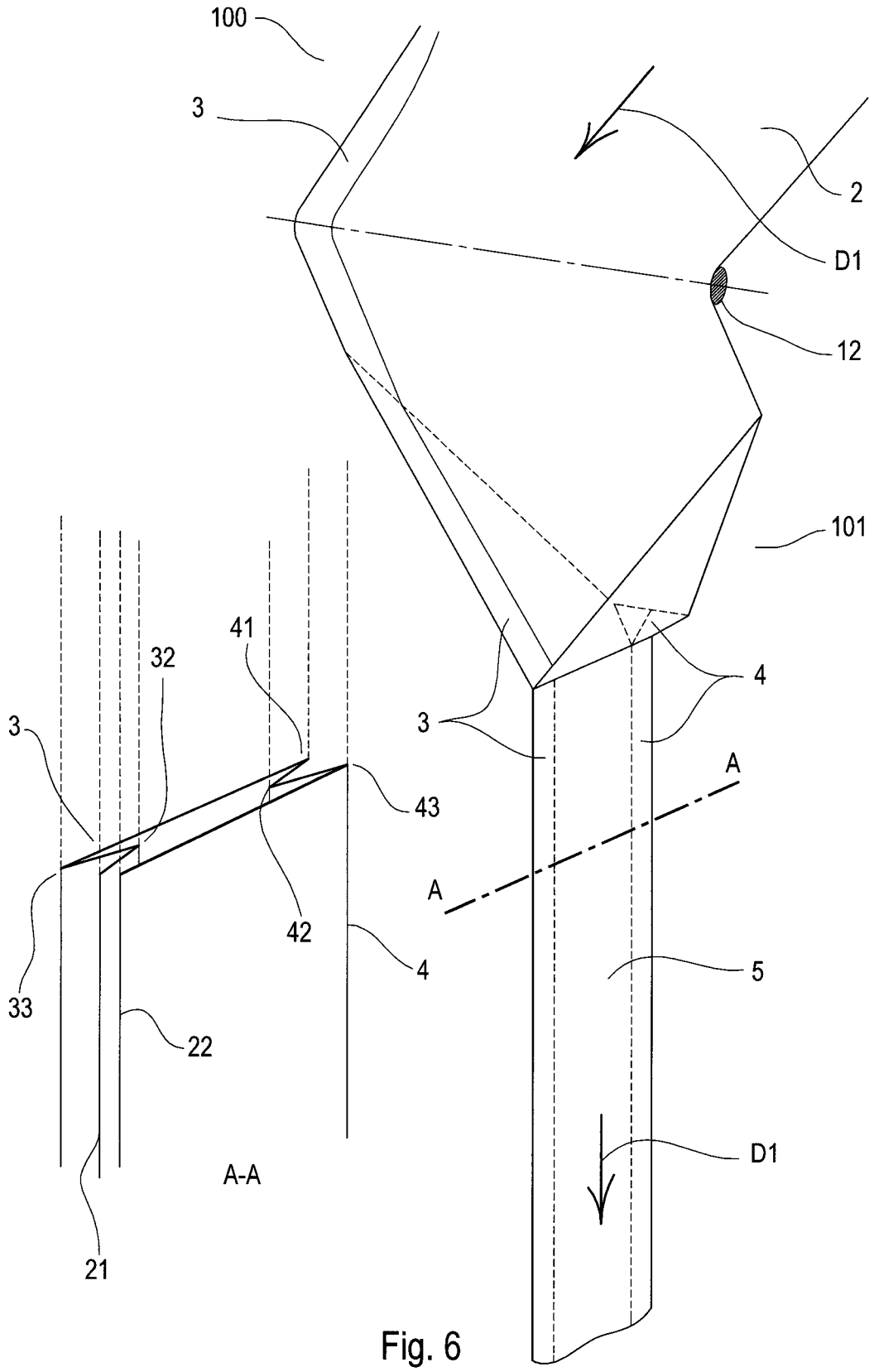
FIG. 6 shows a detail of FIG. 4 in which the tubular element is already formed but not yet closed according to one particular embodiment of the present invention.

As shown in FIG. 6, preferably there may be installed, between the first station 100 and the second station 101, a conveying roller 12 configured to allow an easy sliding of the strip 2 between the first station 100 and the second station 101.

The section A-A of FIG. 6 shows a section view of the tubular element 5. As shown, in addition to forming the second gusset 4, the second station 101, by means of the folding step described above, allows positioning the two side edges 21, 22 of the strip 2 at each other so that the open tubular element 5 is thus ready to be closed at the first gusset 3 so as to form a true tubular element.

Figure 7:
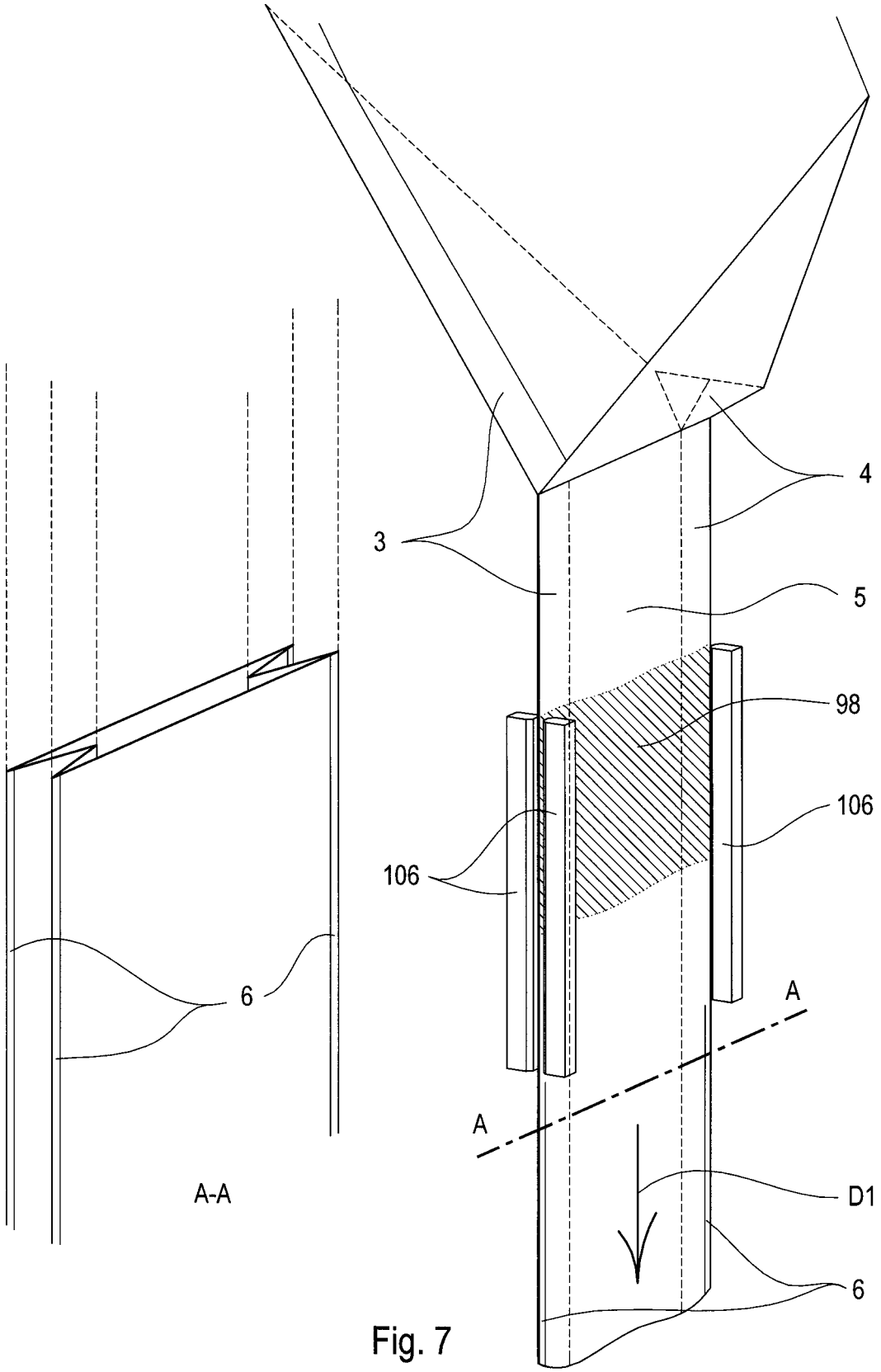
FIG. 7 diagrammatically shows the step of making the lateral seal according to one particular embodiment of the present invention.

As shown in FIG. 7, the tubular element 5 in turn is conveyed into a sealing station preferably formed by two sealers. Here, the sealers each have a pair of side sealing bars 106 configured so as to seal the surfaces next to the outer side ends of the tubular element so as to obtain a sealed surface 6 at the outer edges of each gusset. For example, such surface may have a width which may preferably vary between 3 and 15 mm.

The distance between the second station 101 and the sealing station is independent from the distance between the first station 100 and the second station 101 and may be placed as desired.

The sealing bars 106 may preferably be configured so as to continuously seal. This results in the sealing bars 106 being configured, during the sliding of the strip 2, so as to always be in contact with the outer edges of the gussets and by heating them, forming the sealing surfaces 6 described above. In practice, the tubular element 5 slides in the sealing bars 106, thus being continuously sealed.

In the settings step, the sealing bars 106 are initially opened to accommodate a first portion of tubular element 5. After such portion is received, they preferably are closed so as to always be in contact with the tubular element 5 and so as to perform a continuous sealing. This solution is particularly advantageous because thereby it is possible to have a process for continuously making packages 99, not having to stop the rotation of the reel 1 to make such sealed surfaces 6.

However, it is also possible for such sealing bars 106 to be configured so as to make a seal in an alternating manner. In this particular embodiment, it therefore is preferable for the side sealing bars 106 to have a length equal to at least the length of the package 99 so as to make one package after the other in an alternating manner.

The length of the sealed surface preferably is equal to the length of the final package 99. However, in particular cases, for example in the case of making a package having a flat folded bottom, it may be possible for such folded surface to be only partly laterally sealed or not be sealed at all.

In this particular embodiment, four sealed surfaces 6 are formed among which only one—that is the one at the first gusset 3 that joins a side edge 21 of the strip 2 with the other side edge 22 of the strip 2 (as shown in the detail in FIG. 5)—serves the function of closure of the tubular element. Therefore, it is also possible to install a single sealer with a single side sealing bar 106 (not depicted) configured so as to close the tubular element 5 by performing one seal alone between the first edge 21 and the second edge 22 of the strip 2.

The other three sealed surfaces 6 serve the purpose of reinforcing the gussets. Indeed, it is possible that by applying a given force, for example to open the package, there is a risk for the outer folding corners 33, 41, 43 of the first and of the second gusset 3, 4 to tear. However, by reinforcing the folding corners 33, 41, 43 with such sealed surfaces 6, it is possible to effectively prevent such tears. Moreover, such sealed surfaces 6 also serve a structural function because they give increased stability and structural resistance to the package 99 and help the squaring once the package 99 is filled.

As is shown, after the closure sealing occurs, the tubular element 5 preferably has a perfectly flat shape, similar to the one of a sheet. This solution is particularly advantageous because it allows simplifying the following processes such as for example, sealing the bottom, and even allows winding the tubular element onto a reel.

Figure 8:
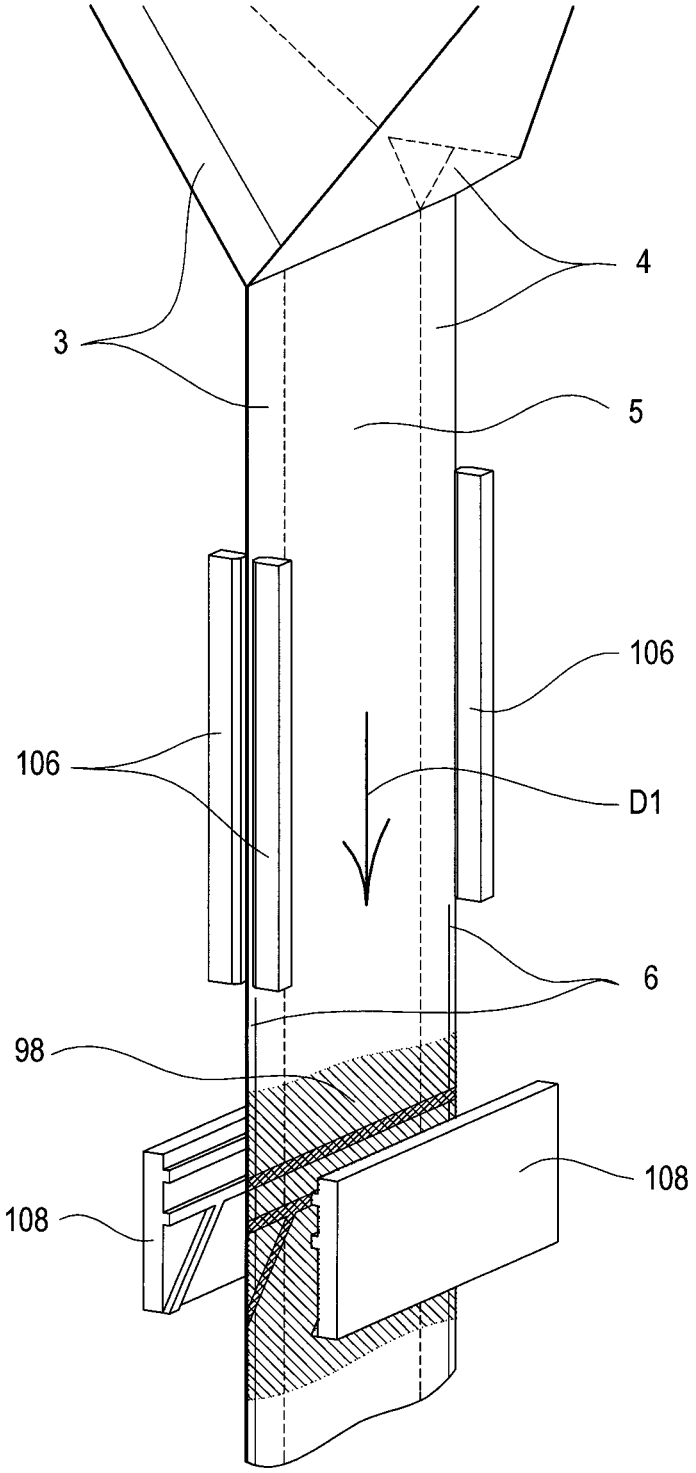
FIG. 8 diagrammatically shows the step of making the transverse seal and the K seal according to one particular embodiment of the present invention.

After the sealing described above occurs, the tubular element 5 is conveyed along the conveying direction D1 into another sealing station (as shown in FIG. 8) configured so as to form the closure of each individual package.

In the particular embodiment of FIG. 8, the sealing is preferably performed by means of a pair of sealing bars 108 configured so as to make two sealed surfaces 8. A first upper strip having a width equal to the width of the tubular element 5 and a second surface having a "K" shape are made. These two sealed surfaces 8 may be made both in a continuous and in an alternating manner. The K structure is particularly advantageous here because it allows closing the bottom inner edges of the package 99, thus simultaneously preventing the product from entering the gap that would be created if such sealing were not performed. Moreover, such type of sealing allows forming the square bottom of the package, giving it also an increased structural resistance and rigidity.

Preferably, the sealing bars 108 are configured so as to be alternately opened and closed and so as to follow the movement of the tubular element 5. Indeed, to have a good seal, it is preferable for the sealing bars 108 to close, contacting the tubular element 5 and following the movement of the strip until the sealing is completed, and only after the sealing is completed do they open again. Then the sealing bars 108 may return to the starting position. Thereby it is possible to have a process for continuously making packages 99, not having to stop the rotation of the strip 2 to make the sealed surfaces 8 of each package.

However, it is also clear that the sealed surface may have any shape such as for example, the one of two parallel strips or also the one of a single strip. The thickness of the closure sealed surface may be selected and mainly depends on the design characteristics and on the quantity of material contained in the package.

Figure 9:
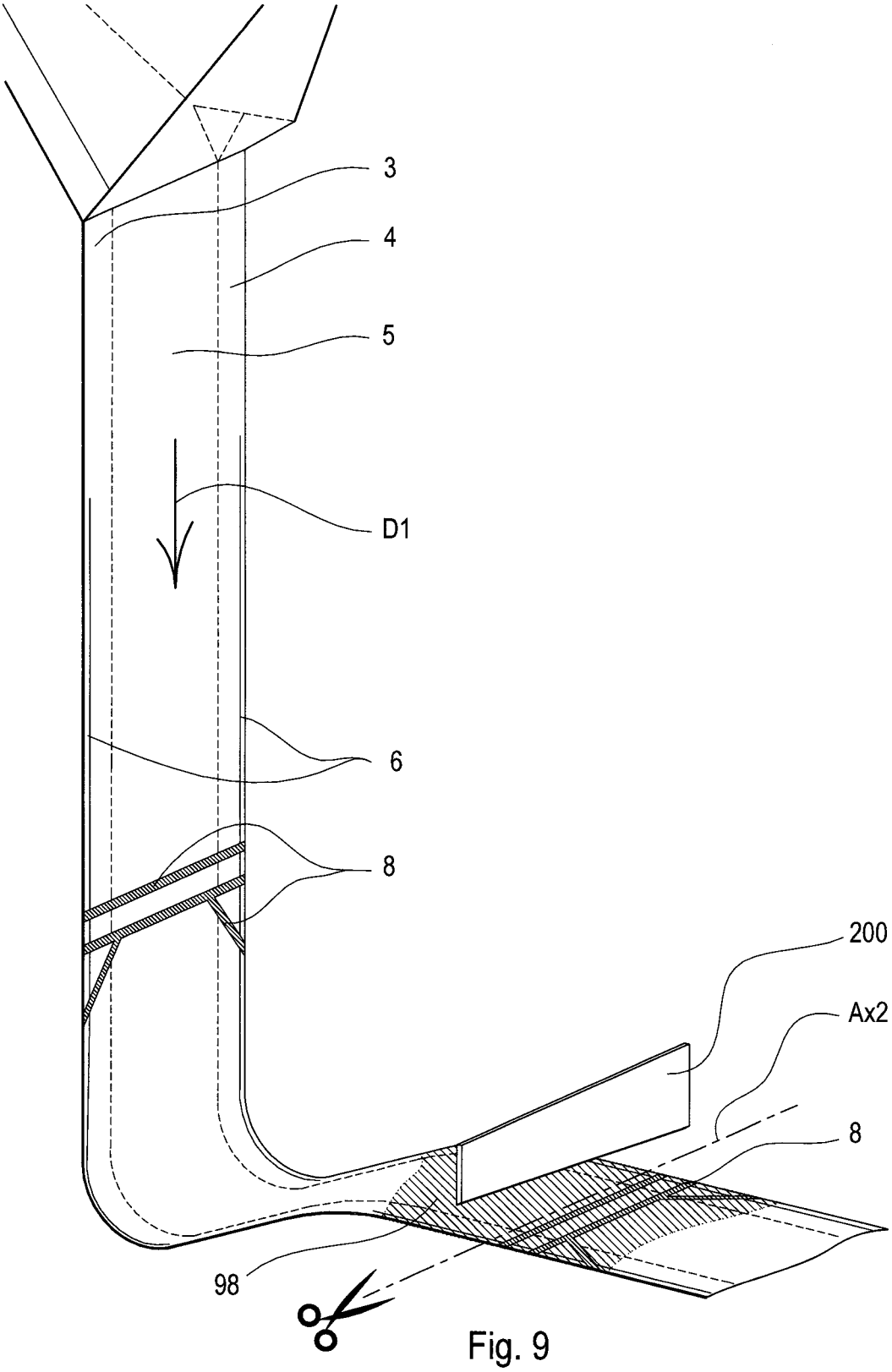
FIG. 9 diagrammatically shows the conveying of the tubular element towards the cutting station according to one particular embodiment of the present invention.

At this point, in the particular embodiment depicted in FIG. 9, the tubular element 5 is conveyed into a cutting station in which there are cutting means 200 such as for example, a cutter configured so as to separate one package from the next.

Figure 10:
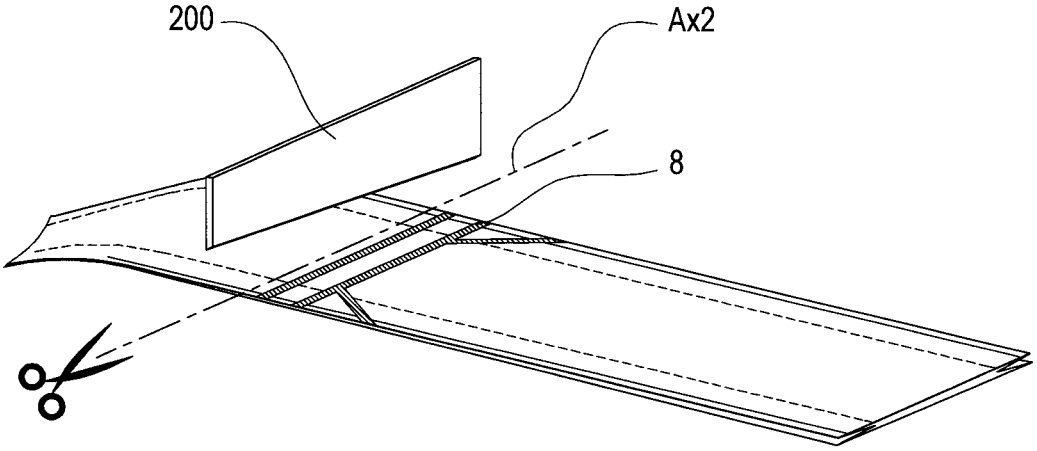
FIG. 10 shows a detail of FIG. 8.
Figure 11:
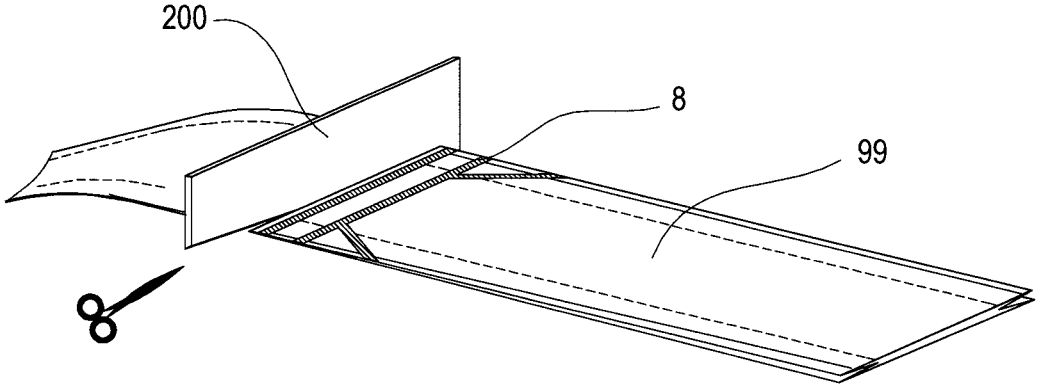
FIG. 11 shows the cutting step according to one particular embodiment of the present invention.

As shown in the detail of FIG. 10, the cutter 200 is configured so as to cut the tubular element 5 along a cutting axis Ax2 placed upstream with respect to the sealed surface. Therefore, two packages placed next to each other preferably are separated by means of the cut depicted in FIG. 11. Simultaneously, the cut will define the bottom edge of a package and the top opening mouth of a successive package.

Figure 12:
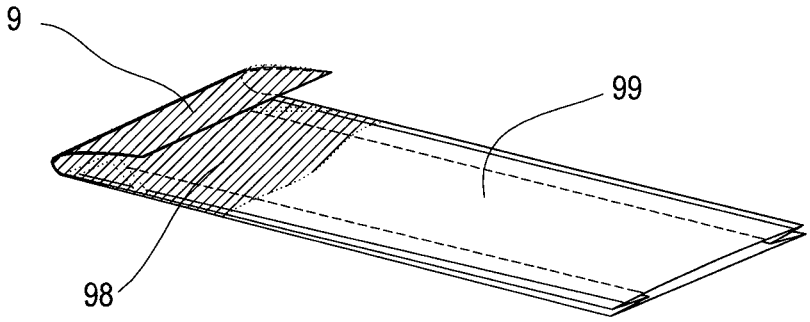
FIG. 12 shows the step of folding the bottom of the package according to one particular embodiment of the present invention.

As shown in FIG. 12, the bottom edge of the package preferably is folded along a direction perpendicular to the sliding direction D1 so as to form a particularly sturdy bottom of the package 99. To this end, the folded surface 9 of the package 99 may preferably be secured, for example glued, to the main body of the package 99. To this end, hot glue points preferably are applied and the bottom is rotated by two side grippers (not depicted) preferably using the highest-positioned sealing line 8 as pivot.

Then the package 99 thus formed may directly be filled (not shown) or it may be sold empty as a ready-to-be-filled package. For example, the package formed according to the present invention may be supplied to a filling machine, for example a carousel filling machine like the one described in PCT application published under number WO 2008/114113 A1.

The present invention may be combined with the formation of one or more rounded edges of the package and the formation of a facilitated opening in the package, as described for example in Italian Patent Application No. 102016000034876.

It is also possible to combine the present invention with the closure of the package and the formation of a handle in the package, as described in Italian Patent Application No. 102016000106959. An opening of the package may also be implemented, as described in the same Italian Patent Application No. 102016000106959.

Although the present invention was described with reference to the embodiments described above, it is clear to the skilled expert that it is possible to make various modifications, variations and improvements to the present invention in light of the teaching described above and within the scope of the appended claims, without departing from the object or scope of protection of the invention.

For example, individual packages separated from one another by means of cutting are the final product in the present invention. However, the cutting process may be omitted and the final product may be the tubular element which may for example, be wound onto a reel.

Moreover, although the first gusset 2 in the particular embodiment presented was made at the first side edge 21 of the strip 2, it is clear to the skilled expert that the first gusset may similarly be made at the second side edge 22.

Moreover, the folding process of the bottom of the package may be completely omitted.

Finally, those scopes deemed to be known by skilled experts were not described to avoid uselessly excessively overshadowing the invention described.

Accordingly, the invention is not limited to the embodiments described above, but is only limited by the scope of protection of the appended claims.

What is claimed is:

1. A method for forming packages of flexible material having a first side gusset and a second side gusset starting from a strip coming from a reel and having a sliding direction, said method comprising the following steps:

a) making said first gusset by means of folding close to a first side edge of said strip;

b) making said second gusset by means of folding said strip; and c) folding said strip so that the first side edge of said strip is at a second side edge of said strip so as to form an open tubular element;

wherein said step b) is performed on a portion of said strip which extends in the sliding direction after said step a) was performed on said portion, wherein said steps a) and b) occur simultaneously during formation of different packages, but they occur one following the other with reference to a given position along said sliding direction of said strip;

wherein said step c) is performed on said portion of said strip which extends in the sliding direction while said step b) is performed on said portion.

2. The method according to claim 1, wherein:

said portion has a length ranging from ¼ of a height of one of the packages to four times the height of one of the packages.

3. The method according to claim 1, further comprising the following step:

d) sealing the side edges of said strip so as to make a closed tubular element;

wherein said step d) is performed on said portion of said strip which extends in the sliding direction after said step c) was performed on said portion.

4. The method according to claim 3, further comprising the following step:

e) sealing outer side edges of the first and second gussets so as to reinforce said outer side edges;

wherein said step e) is performed on said portion of said strip which extends in the sliding direction at the same time said step d) is performed on said portion.

5. The method according to claim 1, further comprising the following step:

f) sealing a transverse surface of the tubular element made from said strip, wherein a seal formed by said sealing has a length equal to a distance between an outer edge of said first gusset and an outer edge of said second gusset so as to make a bottom closure of the package;

wherein said step f) is performed on a portion of said tubular element which extends in the sliding direction after said step c) was performed on said portion.

6. The method according to claim 1, further comprising the following step:

g) cutting the tubular element made from said strip along an axis perpendicular to a sliding direction of the tubular element so as to separate the packages of flexible material from one another.

7. The method according to claim 6, wherein said cutting step g) is followed by the following step:

h) folding a surface placed at a bottom of said tubular element made from said strip along a direction perpendicular to the sliding direction of the tubular element and securing said surface by means of an application of glue so as to make a bottom of said package.

8. The method according to claim 1, wherein:

said reel is unwound in a continuous manner so as to form a plurality of packages.

9. A method for forming packages of flexible material having a first side gusset and a second side gusset from a strip of the flexible material coming from a reel and having a sliding direction, said method comprising the steps of:

forming the first gusset close to a first side edge of the strip of the flexible material;

forming the second gusset after said step of forming the first gusset, the second gusset formed at a location intermediate the first side edge of the strip of the flexible material and an opposing second side edge of the strip of the flexible material;

joining the first side edge to the second side edge of the strip of the flexible material while forming the second gusset, whereby a tube is formed;

forming a seal between the first gusset and the second gusset; and cutting the flexible material adjacent the seal between the first gusset and the second gusset;

wherein said steps of forming said first gusset and forming said second gusset occur simultaneously during formation of different packages, but they occur one following the other with reference to a given position along said sliding direction of said strip, whereby the packages are capable of being formed on a machine having a reduced dimension relative to a width of the strip of the flexible material.

10. A method for forming packages of flexible material having a first side gusset and a second side gusset from a strip of the flexible material having a width, coming from a reel, and having a sliding direction, said method comprising the steps of:

forming the first gusset with a first gusset forming station adjacent to a first side edge of the strip of the flexible material, thereby creating a partially formed strip of flexible material having a central zone of the width;

positioning a second gusset forming station downstream of the first gusset forming station and in a location at the central zone of the partially formed strip of flexible material;

forming the second gusset after said step of forming the first gusset with the second gusset forming station, the second gusset formed at a location intermediate the first side edge of the strip of the flexible material and an opposing second side edge of the strip of the flexible material;

joining the first side edge to the second side edge of the strip of the flexible material while forming the second gusset, whereby a tube is formed;

forming a seal between the first gusset and the second gusset; and cutting the strip of the flexible material adjacent the seal between the first gusset and the second gusset;

wherein said steps of forming the first gusset and forming the second gusset occur simultaneously during formation of different packages, but they occur one following the other with reference to a given position along the sliding direction of the strip of the flexible material, whereby the packages are capable of being formed on a machine having a reduced dimension relative to the width of the strip of the flexible material.

* * * * *